US007744509B1

(12) United States Patent
Emmert

(10) Patent No.: US 7,744,509 B1
(45) Date of Patent: Jun. 29, 2010

(54) REINFORCEMENT MEMBER TO ENHANCE ROTATIONAL MOTION SUCH AS FOR USE IN A STILT DEVICE

(75) Inventor: Raymond L. Emmert, Humacao, PR (US)

(73) Assignee: Emmert Second Limited Partnership, Humacao, PR (US)

( * ) Notice: Subject to any disclaimer, the term of this patent is extended or adjusted under 35 U.S.C. 154(b) by 1070 days.

(21) Appl. No.: 11/361,241

(22) Filed: Feb. 24, 2006

(51) Int. Cl.
*A63B 25/00* (2006.01)

(52) U.S. Cl. ..... 482/75

(58) Field of Classification Search ..... 482/75–77, 482/23, 27–29; 623/28
See application file for complete search history.

(56) References Cited

U.S. PATENT DOCUMENTS

| | | | | |
|---|---|---|---|---|
| 2,736,902 | A | 3/1956 | Bass | |
| 2,747,300 | A | 5/1956 | Field | |
| 2,802,217 | A | 8/1957 | Wilhoyte | |
| 2,837,335 | A | 6/1958 | Koenig | |
| 3,058,120 | A | 10/1962 | Smith et al. | |
| 3,102,272 | A | 9/1963 | Emmert | |
| 3,902,199 | A | 9/1975 | Emmert | |
| 4,226,550 | A | 10/1980 | Kupcak et al. | |
| 4,415,063 | A | 11/1983 | Hutchison | |
| 5,645,515 | A | 7/1997 | Armstrong et al. | |
| 6,517,586 | B2 | 2/2003 | Lin | |
| 6,840,893 | B2 | 1/2005 | Yoon | |
| 2002/0137598 | A1 * | 9/2002 | Publicover et al. | 482/27 |
| 2003/0203793 | A1 * | 10/2003 | Emmert | 482/75 |

* cited by examiner

*Primary Examiner*—Fenn C Mathew
(74) *Attorney, Agent, or Firm*—Fellers, Snider, et al.

(57) ABSTRACT

Apparatus for enhancing relative rotation between a substrate and a rotatable member. The substrate preferably comprises a pole of a leg support assembly in a stilt device, and the rotatable member preferably comprises a leg engagement assembly of the stilt device which engages a user's leg. The reinforcement member preferably operates as a spacer for the substrate, as well as to reduce wear between the substrate and an elongated member which couples the rotatable member to the substrate. A limit surface of the reinforcement member limits mechanical deflection of the elongated member and preferably comprises an annular sidewall of an aperture. A locking feature of the reinforcement member preferably comprises a tab which engages a channel in the substrate to maintain a desired axial orientation of the reinforcement member.

16 Claims, 4 Drawing Sheets

REINFORCEMENT MEMBER TO ENHANCE ROTATIONAL MOTION SUCH AS FOR USE IN A STILT DEVICE

FIELD OF THE INVENTION

Without limitation, the present invention relates generally to extension mechanisms (stilt devices) used to allow a user to maneuver at an increased height, and more particularly to a reinforcement member used to provide spacer support and reduce wear between a leg engagement assembly and a leg support pole.

BACKGROUND

Leg extension mechanisms (stilt devices) advantageously allow a user to maneuver at an increased height above a base surface. Stilt devices are often used in the construction industry to allow users to perform building or repair operations several feet above the ground and which could not otherwise be reachable without use of a scaffold or other support structure.

A particularly useful stilt device is disclosed in U.S. Pat. No. 3,902,199 issued to Emmert. While operable, there remains a continual need for advancements in the art to improve operational characteristics of such devices, and it is to these and other improvements that preferred embodiments of the present invention are generally directed.

SUMMARY OF THE INVENTION

Preferred embodiments of the present invention are generally directed to a reinforcement member provided to enhance relative rotation between a substrate and a rotatable member. The substrate preferably comprises a pole of a leg support assembly in a stilt device, and the rotatable member preferably comprises a leg engagement assembly which engages a leg of a user of the stilt device.

The reinforcement member preferably operates as a spacer for the substrate and reduces wear between the substrate and an elongated member, such as a threaded fastener, which couples the rotatable member to the substrate.

In accordance with some preferred embodiments, the substrate comprises a wall surface and the elongated member comprises a sidewall which extends adjacent the wall surface to form a gap therebetween. The elongated member preferably facilitates relative rotation between the substrate and the rotatable member about a central axis along which the elongated member is nominally aligned.

The reinforcement member preferably comprises a limit surface which extends adjacent the sidewall of the elongated member to form a second gap therebetween. The limit surface is preferably configured to reduce mechanical contact between the sidewall of the elongated member and the wall surface of the substrate as a result of mechanical deflection of the elongated member away from the central axis and toward the wall surface during said relative rotation.

The reinforcement member further preferably comprises a locking feature which engages the substrate to substantially prevent axial displacement of the reinforcement member relative to the substrate. In this way, the wall surface and the limit surface are substantially maintained in a fixed relationship with respect to the central axis.

The reinforcement member preferably comprises a cap portion configured to engage a second wall of the substrate, a body which depends from the cap portion, and a collar portion which extends from the body. The limit surface preferably comprises an annular sidewall of an aperture which extends through the collar portion. The locking feature of the reinforcement member preferably comprises a tab which extends from the body and engages a channel in the substrate.

While a variety of materials can be utilized, the substrate and the elongated member are both preferably formed of metal, and the reinforcement member is preferably formed of nylon or other material with suitable wear resistance characteristics. In this way, the reinforcement member prevents or reduces metal-on-metal wear between the substrate and the elongated member.

These and various other features and advantages which characterize the claimed invention will be apparent from a reading of the following detailed description and a review of the associated drawings.

DETAILED DESCRIPTION

Numerous possible variations and modifications will readily occur to the skilled artisan upon a review of the following discussion. Thus, it will be understood that the various exemplary embodiments disclosed herein are illustrative of, and are not limiting to, the scope of the claimed invention.

Figure 1:
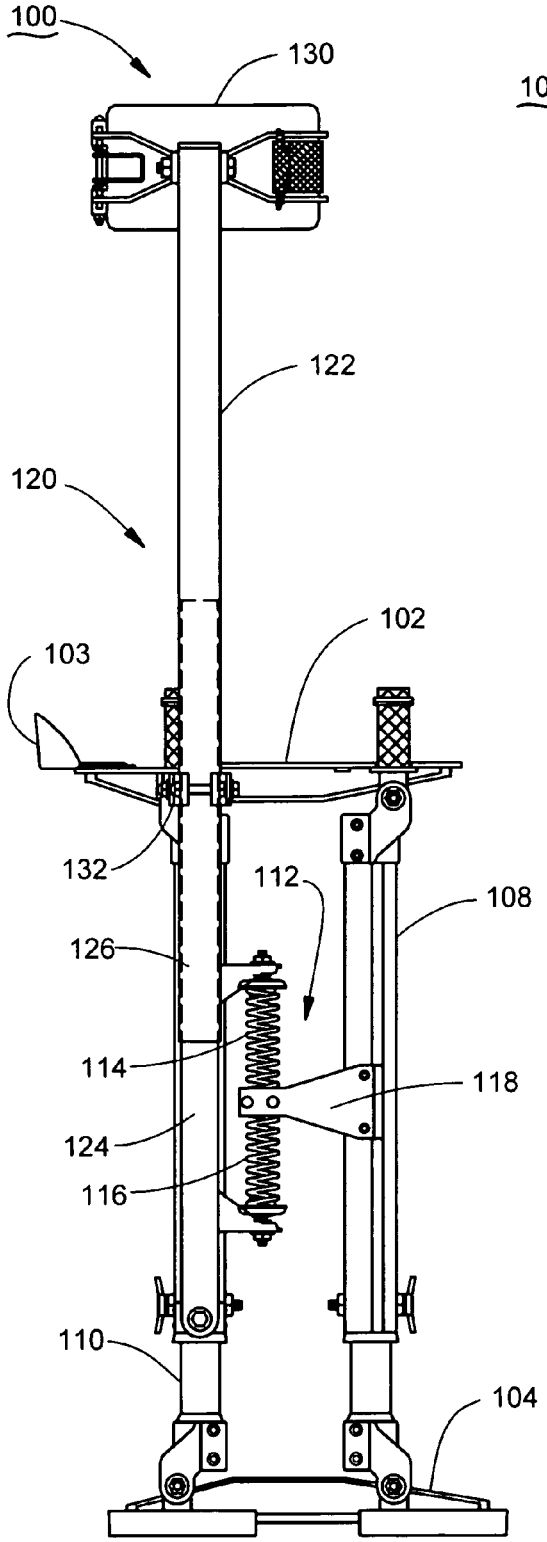
FIG. 1 provides an elevational side view representation of a stilt device constructed in accordance with preferred embodiments of the present invention.
Figure 2:
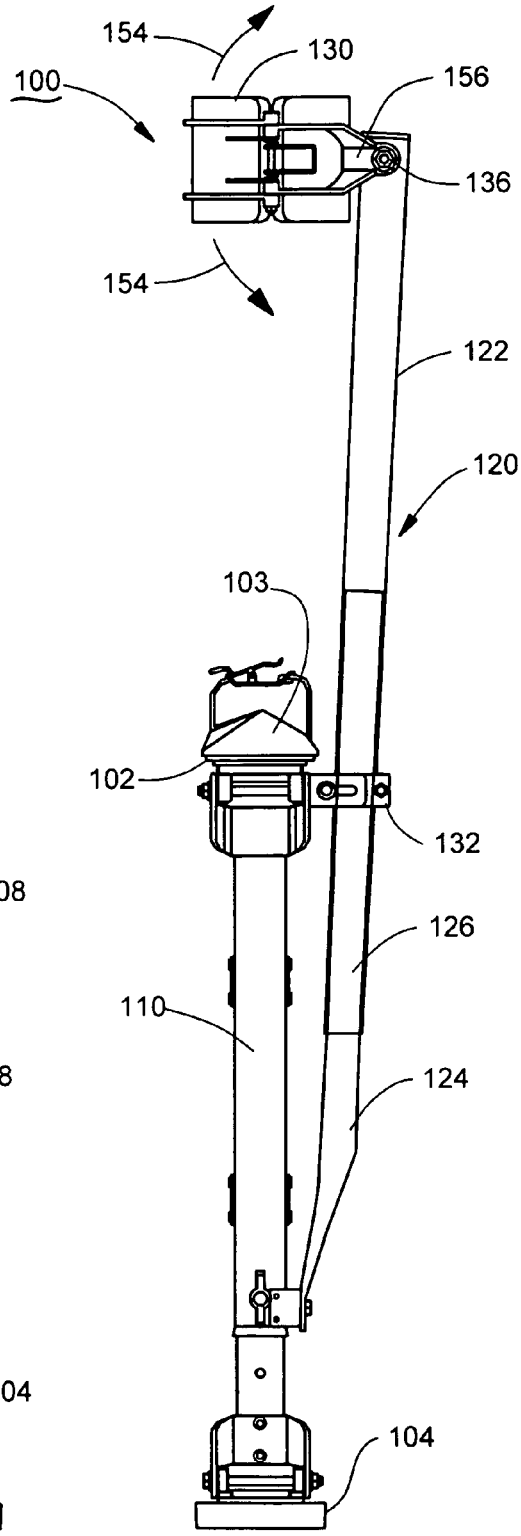
FIG. 2 provides an elevational rear view representation of the stilt device.

FIGS. 1 and 2 show side and rear elevational views, respectively, of a stilt device 100 configured to support a user above a base support (floor) surface (denoted at 101).

A normally horizontal top member, or shoe bracket 102 is configured to abuttingly support a shoe or boot worn by a user (not shown). An arcuate heel plate 103 extends upwardly at the rear of the shoe bracket 102 to abuttingly support the heel of the user's shoe or boot.

The shoe bracket 102 is supported above base support member, or foot member 104 by front and rear struts 108, 110. The struts 108, 110 are preferably telescopic in nature to allow the user to selectively adjust via fasteners 111 the relative height of the shoe bracket 102 above the base support surface 101.

A damping assembly 112 comprises upper and lower damping springs 114, 116 affixed to the rear strut 110 and a rigid actuator arm 118 which extends from the front strut 108 to a medial position between the springs 114, 116. The damping assembly 112 nominally biases the stilt device 100 to the parallelogram shape shown in FIG. 1. The damping assembly 112 further provides flexibility to the user by permitting limited forward and rearward pivoting of the struts 108, 110 with respect to the shoe bracket 102 during maneuvering by the user.

A leg attachment assembly 120 comprises a telescopic support pole 122 (support) which can be adjusted as desired to fit the leg of the user. The support 122 includes inner and outer sleeves 124, 126. A proximal end of the inner sleeve 124 is affixed to the rear strut 110 and a distal end of the inner sleeve 124 is inserted up into the outer sleeve 126.

The leg attachment assembly 120 further preferably comprises a leg attachment (clam-shell) assembly 130 and a support attachment assembly 132. A distal end of the outer sleeve 126 supports the clam-shell assembly 130 as discussed below to support the user's leg at a position just below the user's knee. The lateral extent and relative angle of the support 122 with respect to the shoe bracket 102 are adjustable using the support attachment assembly 132.

It is envisioned that during normal usage a user will typically wear two such stilt devices 100, with one being attached to each leg. The two stilt devices 100 will generally be configured in a mirrored fashion so that the support 122 extends along the outside of each leg. Thus, it will be understood that the stilt device 100 shown in the drawings is a "right-footed" version, and the corresponding "left-footed" version has been omitted for simplicity of discussion.

Figure 3:
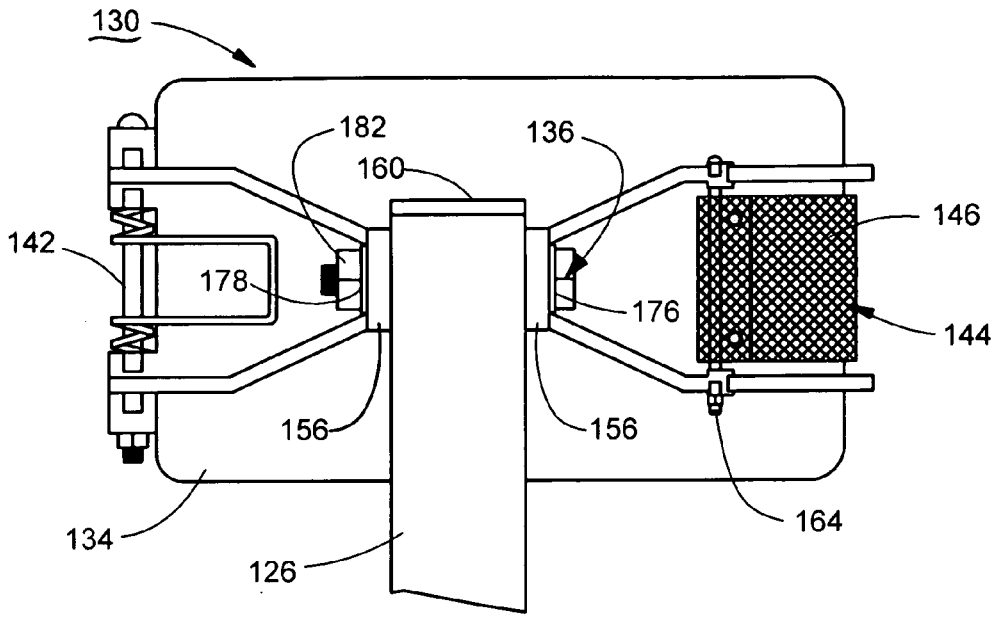
FIG. 3 provides a side view of a clam-shell assembly configured to engage a leg of the user in conjunction with a reinforcement member constructed in accordance with preferred embodiments of the present invention.
Figure 4:
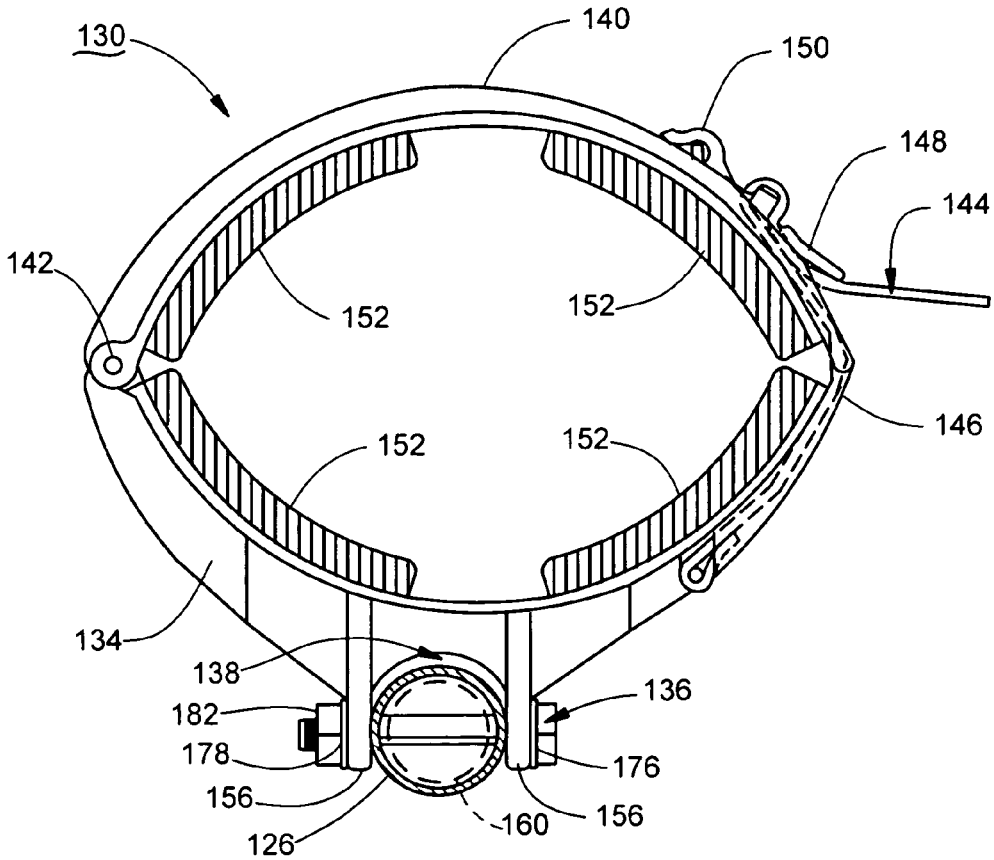
FIG. 4 provides a top plan view of FIG. 3.

FIGS. 3 and 4 provide side and top plan views, respectively, of the clam-shell assembly 130. The assembly 130 includes a curved outer plate 134, which is affixed to the outer sleeve 126 of the support 122 via fastener 136. A gap shown at 138 in FIG. 4 permits a limited amount of pivotal (rotational) movement of the outer plate 134 with respect to the sleeve 126 to improve comfort and flexibility for the user.

A curved inner plate 140 is disposed in facing relation to the outer plate 134. The inner plate 140 is pivotally affixed to the outer plate 134 via hinge pin 142. A biasing spring 143 preferably biases the inner and outer plates to the closed position as shown in FIG. 4. For clarity, the use of the terms "inner" and "outer" are referenced with respect to the user's leg (e.g., the inner plate 140 is disposed adjacent the inner portion of the user's leg).

A strap assembly 144 secures the inner and outer plates 134, 140 in the closed position around the user's leg during use. The strap assembly 144 includes a flexible nylon or similar strap 146 and a threaded buckle 148. A proximal end of the strap 146 is affixed to the outer plate 134, and the buckle 148 engages a tab 150 on the inner plate 140. In a preferred embodiment, foam blocks 152 are affixed along the interior surfaces of the inner and outer plates 134, 140 to provide further cushioning for the user. The inner and outer plates 134, 140 are preferably formed from injection molded plastic, nylon, or other suitable material.

As mentioned above, the clam-shell assembly 130 is preferably configured to provide a limited range of rotational movement about the fastener 136. This range of motion is generally denoted by arrows 154 in FIG. 2. Collar members 156 extend from the outer plate 134 to positions adjacent opposing sides of the pole 122 to receive the fastener 136. In this way, the assembly 130 pivots about a central axis along which the fastener 136 is aligned, and the upper and lower extents of travel by the assembly 130 are limited by respective contacting engagement of the plate 134 with the pole 122.

Figure 5:
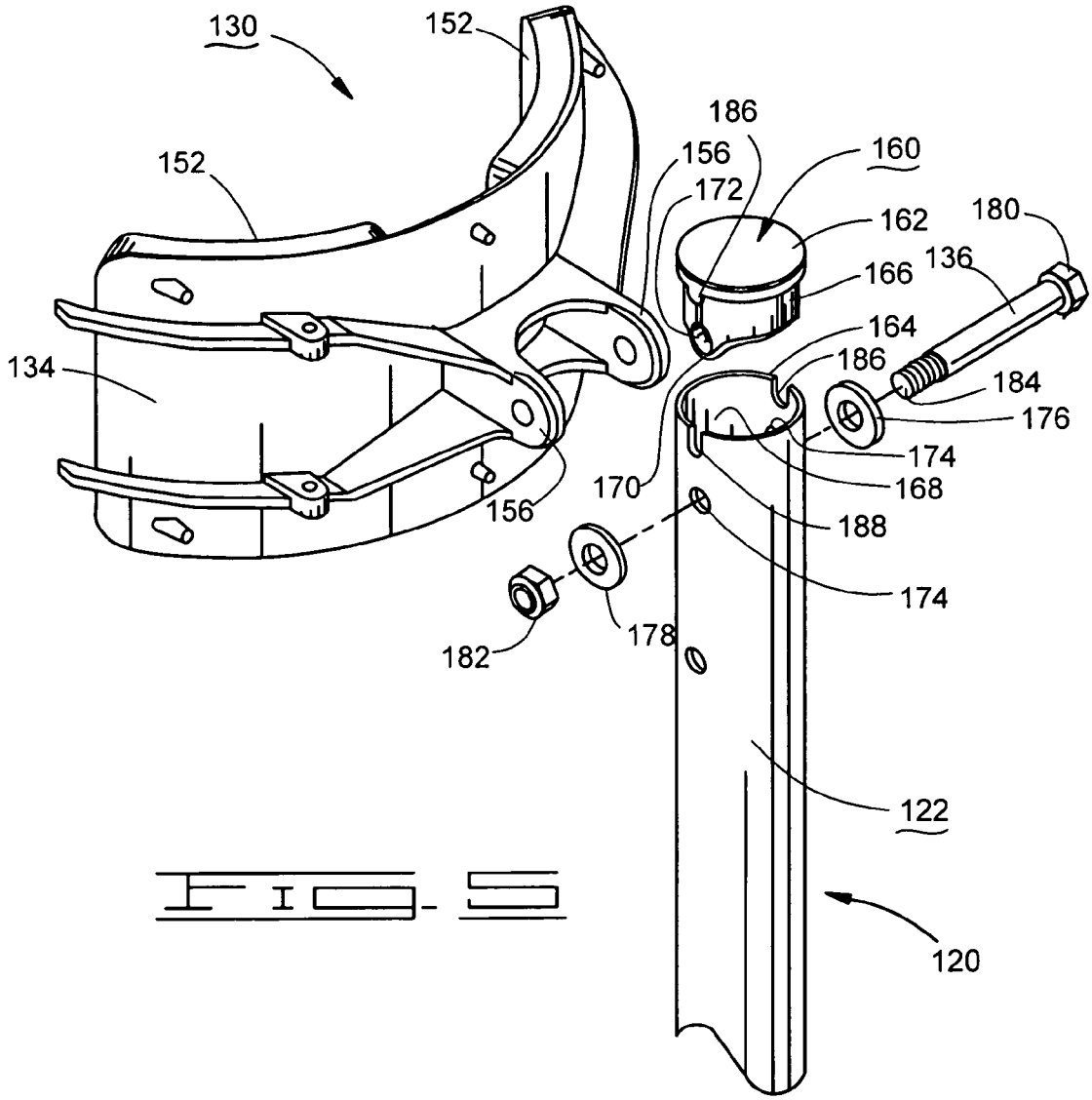
FIG. 5 provides an isometric, exploded view of relevant portions of FIGS. 3 and 4 to illustrate the reinforcement member in greater detail.

Referring now to FIG. 5, a reinforcement member 160 is preferably provided to enhance the rotational movement by the clam-shell assembly 130. The member 160 advantageously operates to provide increased structural support, and reduces wear upon the pole 122. The reinforcement member 160 is preferably formed from injection molded plastic, nylon, or other suitable material.

Figure 6:
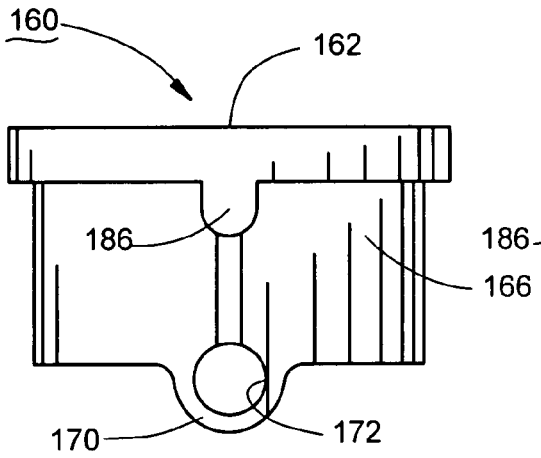
FIG. 6 is an elevational view of the reinforcement member in a first direction.
Figure 7:
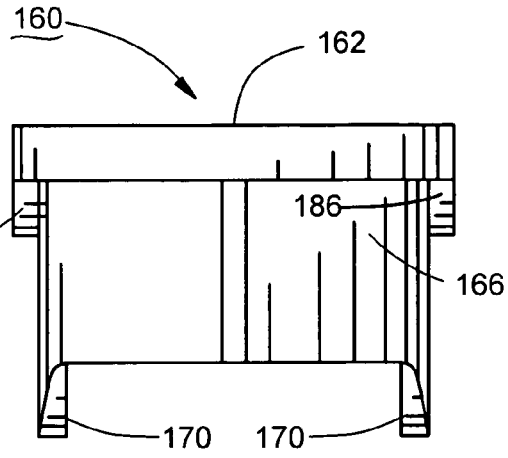
FIG. 7 is another elevational view of the reinforcement member in a second member orthogonal to the first direction.

As further shown in FIGS. 6 and 7, the reinforcement member 160 preferably includes an annular cap portion 162 sized to abut a distal surface 164 of the pole 122. An annular body 166 depends from the cap portion 162 and is preferably sized to provide a close fit against an interior annular surface 168 of the pole 122. Opposing collar portions 170 depend from the body 166 as shown.

Each collar portion 170 includes a central aperture 172 which substantially aligns with a corresponding aperture 174 of the pole 122. In this way, with reference again to FIG. 5, the fastener 136 is preferably inserted through a first washer 176, the first collar member 156, the first pole aperture 174, the first reinforcement member aperture 122, the second reinforcement member aperture 172, the second pole aperture 174, the second collar member 156, and a second washer 178. A head portion 180 of the fastener 136 is preferably brought into contacting abutment with the first washer 176 and a threaded lock nut 182 engages a threaded end 184 of the fastener 136 to complete the installation.

The reinforcement member 160 is further preferably provided with a pair of opposing retention tabs 186. The tabs 186 abut the cap portion 162 and body 166, and are sized to nest within locking channels 188 formed in the top surface 164 of the pole 122. This preferably operates to maintain the reinforcement member 160 in a fixed rotational orientation with respect to the pole 122.

It can now be seen that the reinforcement member 160 preferably operates as an internal spacer to resist the compressive forces supplied to opposing sides of the pole 122 by the fastener 136 and nut 182. This advantageously enhances the structural rigidity of the pole 122.

Additionally, the reinforcement member 160 preferably reduces wear upon the pole 122 by mechanically isolating the fastener 136 from the pole 122. While a variety of materials can be utilized, in a preferred embodiment the pole 122 comprises aluminum tube stock and the fastener is formed of stainless steel. The reinforcement member 160 is thus configured to reduce metal-on-metal contact and wear between an outer sidewall surface of the fastener 136 and an interior wall surface of the aperture 174 in the pole 122.

Figure 8:
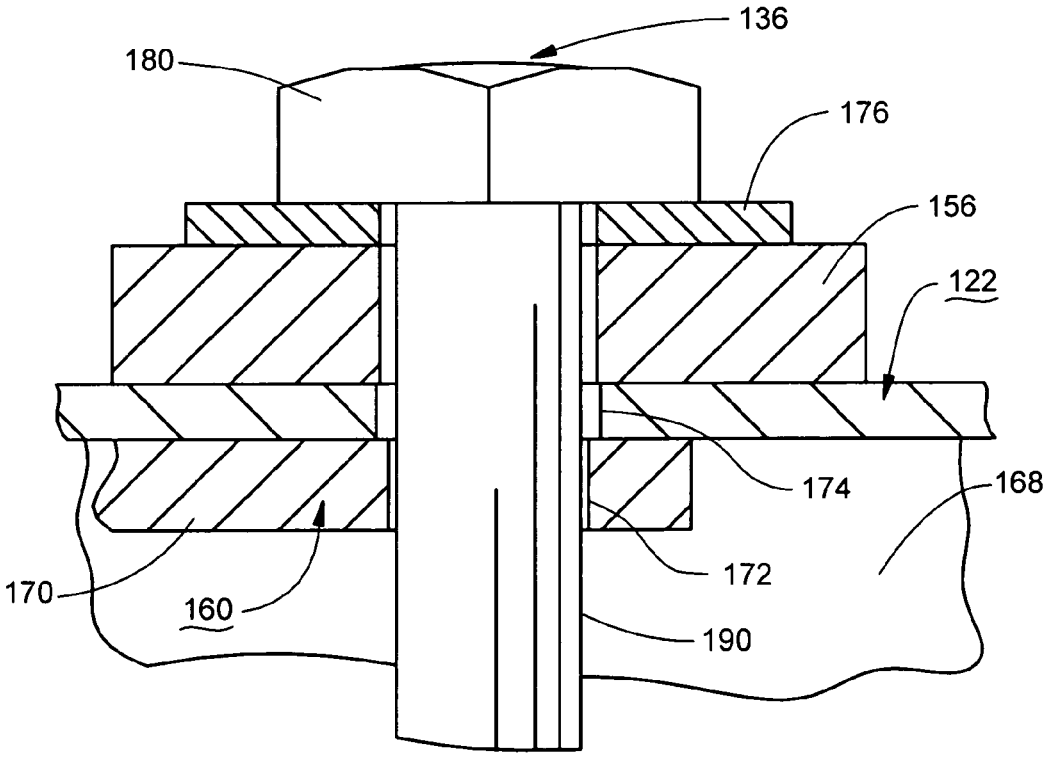
FIG. 8 provides a cross-sectional view to illustrate a preferred installation of the reinforcement member.

As shown in FIG. 8, the apertures 172 of the retaining member 160 are each preferably sized to have a smaller diameter than the corresponding diameters of the apertures 174 of the pole 122. In the event the fastener 136 is induced to move relative to the pole 122 in such a way that the fastener 136 is deflected away from the central rotational axis and toward the wall of the aperture 174, the wall surfaces of the aperture 172 serve to limit the extent to which a wearing action can be made upon the walls of the apertures 174. This advantageously prevents elongation of the apertures 174 over time from a circular to an oval shape.

The locking tabs 186 and channels 188 further limit such wear by maintaining the respective apertures 172, 174 in a common axial alignment. That is, the tabs 186 and channels 188 cooperate to maintain a fixed interrelationship of the wall of aperture 174 and the limit surface of aperture 172 with respect to the central axis.

While the diameter of the aperture 172 is preferably smaller than the diameter of the aperture 174, this is not necessarily required. Rather, as desired the diameter of the aperture 172 can be made the same as, or even larger than the diameter of the aperture 174. The diameter of the fastener 136 (or other elongated member) can also be varied along the length thereof. It will be appreciated that such variations will generally tend to alter the extent to which the limiting operation of the apertures 172 serves to reduce wear upon the support 122.

It is preferred, though not required, that the reinforcement member 160 be formed from a material (e.g., nylon) that is less susceptible to wear from contact with the stainless steel fastener 136 as compared to the support 122 (e.g., aluminum).

While the limit surfaces of the reinforcement member 160 have been disclosed as being preferably annular in shape, such is not necessarily limiting; rather, any suitable shapes can be provided to the limit surfaces. Similarly, the use of a fastener 136 as a pivot member is preferred, but not required; rather, any type of pin or other elongated member can be used depending on the requirements of a given application.

In the same way, the claimed invention is not necessarily limited to the specific embodiments, environment or application disclosed herein. For example, the reinforcement member 160 can be utilized with other types of leg attachment assemblies besides the clam-shell assembly 130. The reinforcement member 160 can also be used with other stilt components, such as in conjunction with the attachment of the foot plate 104, or even in an application that is not stilt-related at all.

Similarly, the substrate through which the elongated member extends need not necessarily be annular as is the case with the exemplary pole 122, but could rather take any number of desired shapes including a substantially flat planar shape, a rectangular tube, etc. While two opposing limit surfaces have been provided by the pair of apertures 172, in other embodiments only a single limit surface is provided, or more than two limit surfaces are provided along the length of the elongated member.

It will now be recognized that some preferred embodiments of the present invention are generally directed to an apparatus comprising a substrate (such as the pole 122) comprising a wall surface (such as the wall of aperture 174), a rotatable member (such as clam-shell assembly 130) adjacent the substrate, and an elongated member (such as fastener 136) comprising a sidewall which extends adjacent the wall surface to form a gap therebetween (see FIG. 8—gap between 174 and 190).

The elongated member facilitates relative rotation between the substrate and the rotatable member (such as denoted by arrows 154) about a central axis along which the elongated member is nominally aligned.

A reinforcement member (such as 160) comprises a limit surface (such as the sidewall of aperture 172) which extends adjacent the sidewall of the elongated member to form a second gap therebetween (see FIG. 8—gap between 172 and 190). The limit surface is configured to reduce mechanical contact between the sidewall of the elongated member and the wall surface of the substrate (e.g., between the pole 122 and fastener 136) as a result of mechanical deflection of the elongated member away from the central axis and toward the wall surface during said relative rotation.

The reinforcement member further preferably comprises a locking feature (such as tab 186) which engages the substrate (such as at channel 188 in surface 164) to substantially prevent axial displacement of the reinforcement member relative to the substrate so that the wall surface and the limit surface are substantially maintained in a fixed relationship with respect to the central axis.

Preferably, the substrate comprises a pole support of a leg support assembly in a stilt device, the elongated member comprises a threaded fastener, and the rotatable member comprises a leg engagement assembly that engages a user's leg.

For purposes of the appended claims, the recited "first means" will be construed as corresponding to the disclosed reinforcement member 160 as shown in FIGS. 4-8.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. An apparatus comprising:

a substrate comprising a wall surface with an annular sidewall of a first aperture that extends through the substrate and has a first overall diameter;

a rotatable member adjacent the substrate;

an elongated member comprising a sidewall which extends adjacent the wall surface to form a first gap therebetween, the elongated member facilitating relative rotation between the substrate and the rotatable member about a central axis along which the elongated member is nominally aligned; and a reinforcement member comprising:

a limit surface which comprises an annular sidewall of a second aperture that extends through the reinforcement member and has a second overall diameter less than the first overall diameter, the limit surface extending adjacent the sidewall of the elongated member to form a second gap therebetween, the limit surface configured to reduce mechanical contact between the sidewall of the elongated member and the wall surface of the substrate as a result of mechanical deflection of the elongated member away from the central axis and toward the wall surface during said relative rotation; and a locking feature which engages the substrate to substantially prevent axial displacement of the reinforcement member relative to the substrate so that the wall surface and the limit surface are substantially maintained in a fixed relationship with respect to the central axis;

wherein the substrate is characterized as a pole, wherein the reinforcement member is characterized as a spacer sized to nest within said pole, and wherein the elongated member successively and concurrently extends through a first side of the pole, through a first side of the reinforcement member, through a second opposing side of the reinforcement member, and through a second opposing side of the pole.

2. The apparatus of claim 1, wherein the wall surface of the substrate comprises an annular sidewall of an aperture that extends through the substrate.

3. The apparatus of claim 2, wherein the aperture is characterized as a first aperture, and wherein the limit surface of the reinforcement member comprises an annular sidewall of a second aperture that extends through the reinforcement member.

4. The apparatus of claim 3, wherein the first aperture has a first diameter, and wherein the second aperture has a second diameter less than the first diameter.

5. The apparatus of claim 1, wherein the elongated member comprises a threaded fastener which engages the substrate and the rotatable member to apply a compressive force thereto.

6. The apparatus of claim 1, wherein the rotatable member comprises a leg attachment assembly configured to engage a leg of a user.

7. The apparatus of claim 1, wherein the reinforcement member comprises a cap portion configured to engage a second wall of the substrate, a body which depends from the cap portion, and a collar portion which extends from the body.

8. The apparatus of claim 7, wherein the limit surface comprises an annular sidewall of an aperture which extends through the collar portion, and wherein the locking feature comprises a tab which extends from the body.

9. An apparatus comprising:

a reinforcement member configured to reduce mechanical wear between a substrate and an elongated member, the reinforcement member comprising:

a limit surface which extends adjacent a sidewall of the elongated member to form a gap therebetween, the limit surface configured to reduce mechanical contact between the sidewall of the elongated member and a first wall surface of the substrate as a result of mechanical deflection of the elongated member away from a central axis and toward the wall surface;

a cap portion configured to engage a second wall surface of the substrate, a body which depends from the cap portion, and a collar portion which extends from the body; and a locking feature which engages the substrate to substantially prevent axial displacement of the reinforcement member relative to the substrate so that the wall surface and the limit surface are substantially maintained in a fixed relationship with respect to the central axis, wherein the wall surface of the substrate comprises an annular sidewall of a first aperture that extends through the substrate and has a first overall diameter, wherein the limit surface of the reinforcement member comprises an annular sidewall of a second aperture that extends through the reinforcement member and has a second overall diameter less than the first overall diameter, and wherein the elongated member concurrently extends through the first and second apertures.

10. The apparatus of claim 9, wherein the limit surface of the reinforcement member comprises an annular sidewall of an aperture which extends through the collar portion, wherein the elongated member extends through said aperture.

11. The apparatus of claim 9, wherein the body is characterized as annular and configured to nest within the substrate.

12. The apparatus of claim 9, wherein the reinforcement member further comprises a second collar portion comprising a second aperture with an annular sidewall configured as a second limit surface, wherein the elongated member further extends through said second aperture.

13. The apparatus of claim 9, wherein the reinforcement member further comprises a spacer surface that engages the substrate to resist a compressive force applied to the substrate by the elongated member.

14. The apparatus of claim 9, wherein the locking feature comprises a tab which engages a corresponding channel in the substrate to establish a desired angular orientation of the reinforcement member with respect to the substrate.

15. The apparatus of claim 9, wherein the substrate comprises a leg support pole of a stilt device leg attachment assembly, wherein the elongated member comprises a threaded fastener that secures an engagement assembly configured to engage a user's leg to the support pole, and wherein the retention member is configured to nest within a distal end of the support pole.

16. The apparatus of claim 9, wherein the substrate and the elongated member are each formed of metal, and wherein the reinforcement member comprises nylon.

* * * * *